US010771889B2

(12) United States Patent
Littrell

(10) Patent No.: US 10,771,889 B2
(45) Date of Patent: Sep. 8, 2020

(54) ACOUSTIC FILTERING

(71) Applicant: Vesper Technologies Inc., Boston, MA (US)

(72) Inventor: Robert J. Littrell, Boston, MA (US)

(73) Assignee: Vesper Technologies Inc., Boston, MA (US)

( * ) Notice: Subject to any disclaimer, the term of this patent is extended or adjusted under 35 U.S.C. 154(b) by 0 days.

(21) Appl. No.: 15/357,075

(22) Filed: Nov. 21, 2016

(65) Prior Publication Data

US 2017/0150248 A1 May 25, 2017

Related U.S. Application Data

(60) Provisional application No. 62/257,923, filed on Nov. 20, 2015.

(51) Int. Cl.

| | |
|---|---|
| ***H04R 1/02*** | (2006.01) |
| ***H04R 1/22*** | (2006.01) |
| ***H04R 19/00*** | (2006.01) |
| ***H04R 1/08*** | (2006.01) |
| ***H04R 31/00*** | (2006.01) |
| *H04R 17/02* | (2006.01) |
| *H04R 19/04* | (2006.01) |

(52) U.S. Cl.

CPC ..... *H04R 1/222* (2013.01); *H04R 1/083* (2013.01); *H04R 19/005* (2013.01); *H04R 31/006* (2013.01); *H04R 17/02* (2013.01); *H04R 19/04* (2013.01); *H04R 2201/003* (2013.01); *H04R 2499/11* (2013.01)

(58) Field of Classification Search

CPC ..... H04R 1/02; H04R 1/222; H04R 1/083; H04R 1/086; H04R 17/02; H04R 19/005; H04R 19/04; H04R 23/006; H04R 2201/003; B81B 2201/0257

USPC ..... 381/355, 356, 357, 358, 359, 360, 361, 381/369, 173, 174, 175, 189; 257/415, 257/416; 438/51, 53; 455/550.1, 575.1

See application file for complete search history.

(56) References Cited

U.S. PATENT DOCUMENTS

| | | | | |
|---|---|---|---|---|
| 8,494,577 | B2 * | 7/2013 | Shiogama | H04M 1/035 455/550.1 |
| 2011/0272769 | A1 * | 11/2011 | Song | H04R 19/005 257/416 |
| 2012/0235256 | A1 | 9/2012 | Zoellin et al. | |

(Continued)

FOREIGN PATENT DOCUMENTS

| | | |
|---|---|---|
| JP | 2008/005439 | 1/2008 |
| KR | 10-2009-0095161 | 9/2009 |

OTHER PUBLICATIONS

Notification of Transmittal of the International Search Report and Written Opinion in corresponding Application No. PCT/US2016/063007 dated Feb. 20, 2017, pp. 1-13.

*Primary Examiner* — Huyen D Le

(74) *Attorney, Agent, or Firm* — Fish & Richardson P.C.

(57) ABSTRACT

A package comprises: a transducer; a substrate comprising an acoustic port, with the transducer attached to a surface of the substrate and over or adjacent to the acoustic port; and a venting mechanism for venting air or sound pressure from a device comprising the package, with the venting mechanism being affixed to the substrate and partially surrounding the acoustic port, and with the venting mechanism being dimensioned to filter out audio frequencies.

18 Claims, 11 Drawing Sheets

(56) References Cited

U.S. PATENT DOCUMENTS

| | | | | |
|---|---|---|---|---|
| 2014/0133687 | A1* | 5/2014 | Lee | H04R 1/083<br>381/355 |
| 2014/0299948 | A1 | 10/2014 | Wang et al. | |
| 2015/0289045 | A1 | 10/2015 | Khenkin et al. | |

* cited by examiner

ACOUSTIC FILTERING

CLAIM OF PRIORITY

This application claims priority under 35 U.S.C. § 119(e) to provisional U.S. Patent Applications 62/257,923, filed on Nov. 20, 2015, the entire contents of which are hereby incorporated by reference.

BACKGROUND

Electronics (e.g., transducers) are often designed with sealed enclosures (e.g., an airtight seal or housing) to protect the electronics from debris, water, and so forth. However, once these electronics are put into use, it is often the case that the airtight housing or seal leaks, because the airtight seals prevent the device's ability to equalize pressure, e.g., when there is a pressure differential. Pressure differentials are often caused by temperature changes. The temperature change can be internal, external or both. As the external pressure fluctuates (thus causing a pressure differential), the enclosure tries to equalize the internal pressure by drawing in air from the outside. If the housing is completely airtight, pressure builds up inside in the form of a positive or negative buildup. Positive buildup causes the housing to bloat, while negative buildup creates a vacuum. Either type of buildup leads to stress on the seal, which in turn compromises and damages it effectiveness. The compromised seals begin to allow water and contaminants to enter the housing, which can ultimately lead to electronic failure. (See, "The Unknown Problem with Airtight Enclosures," www.ElectronicsProtectionMagazine.com).

To protect against these pressure differentials, more robust seals are often used. However, this solution will remedy the immediate leakage and contamination issues, but is a short-term fix that will ultimately fail because the fundamental problem of pressure differentials has not been addressed. The device is simply more airtight without having a solution for the root cause. (See, "The Unknown Problem with Airtight Enclosures," www.ElectronicsProtection Magazine.com).

As described in U.S. Pat. No. 7,439,616, a sealing ring is provide on the bottom of a packaged device that will seal the back volume during surface mounting to a user's board, as show in FIG. 1 (which is FIG. 3 in U.S. Pat. No. 7,439,616).

FIG. 2 is a bird's eye view of the bottom of package 10 shown in FIG. 1. In FIG. 2, substrate 14 of package 10 includes cavity 18. Sealing ring 22 surrounds cavity 18, making package 10 air-tight, when mounted to a board.

SUMMARY

In one aspect, a package comprises: a transducer; a substrate comprising an acoustic port, with the transducer attached to a surface of the substrate and over or adjacent to the acoustic port; and a venting mechanism for venting air or sound pressure from a device comprising the package, with the venting mechanism being affixed to the substrate and partially surrounding the acoustic port, and with the venting mechanism being dimensioned to filter out audio frequencies.

In this aspect, the venting mechanism includes first and second sidewalls defining a gap between the first and second sidewalls, wherein the gap is dimensioned to have a specific acoustic impedance such that air or sound pressure with an audio frequency range does not enter the venting mechanism and is not sensed by the transducer, and air or sound pressure with a frequency that differs from an audio frequency enters the venting mechanism for venting to an atmosphere. The venting mechanism is an open ring. The venting mechanism forms a vent around the acoustic port. The venting mechanism is fabricated from one or more of solder, a metal, epoxy, plastic and fiberglass. The venting mechanism is associated with a threshold frequency level, wherein the venting mechanism is configured to vent out of the device sound pressure with a frequency that exceeds or is less than the threshold frequency level. The transducer is disposed within a sealed volume of the device. The transducer is a piezoelectric transducer, a silicon microphone, a piezoelectric microphone or a silicon condenser microphone. The transducer is comprised of one or more of AlN, PZT, ScAlN, LiNbO3, LiTaO3, GaN and GaAs.

In another aspect, a method include forming a venting mechanism on a package substrate of a package and around an acoustic port of the package substrate, by: forming a first venting sidewall on the package substrate; forming a second venting sidewall on the package substrate that is substantially opposite to the first venting sidewall on the package substrate; wherein a gap between the first and second venting sidewalls is dimensioned to have a specific acoustic impedance to configure the venting mechanism such that air or sound pressure with an audio frequency range that is generated within a device including the package does not enter the venting mechanism and is not sensed by a transducer included in the package, and air or sound pressure that is generated within the device and with a frequency that differs from an audio frequency enters the venting mechanism for venting the air or sound pressure from the device into an atmosphere. In this aspect, forming comprises applying solder around the acoustic port in a shape that forms the venting mechanism.

In yet another aspect, a substrate comprises an acoustic port; and a venting mechanism for venting air or sound pressure, with the venting mechanism being affixed to the substrate and partially surrounding the acoustic port, and with the venting mechanism being dimensioned to filter out audio frequencies.

In this aspect, the venting mechanism includes first and second sidewalls defining a gap between the first and second sidewalls, wherein the gap is dimensioned to have a specific acoustic impedance such that air or sound pressure with an audio frequency range does not enter the venting mechanism, and air or sound pressure with a frequency that differs from an audio frequency enters the venting mechanism for venting to an atmosphere. The venting mechanism is an open ring. The venting mechanism forms a vent around the acoustic port. The venting mechanism is fabricated from one or more of solder, a metal, epoxy, plastic and fiberglass. The venting mechanism is associated with a threshold frequency level, wherein the venting mechanism is configured to vent out of the acoustic device sound pressure with a frequency that exceeds or is less than the threshold frequency level. The device further includes a piezoelectric transducer, a silicon microphone, a piezoelectric microphone or a silicon condenser microphone. The device further includes a transducer comprised of one or more of AlN, PZT, ScAlN, LiNbO3, LiTaO3, GaN and GaAs. The transducer is disposed within a sealed volume of the other device.

All or part of the foregoing may be implemented as an apparatus, method, or electronic system that may include one or more processing devices and memory to store executable instructions to implement the stated functions.

The details of one or more embodiments are set forth in the accompanying drawings and the description below.

Other features, objects, and advantages of the techniques described herein will be apparent from the description and drawings, and from the claims.

DETAILED DESCRIPTION

Using the techniques described herein, a venting mechanism (e.g., a vent) is built into solder partially surrounding an acoustic port and/or an opening of a device (e.g., a mobile device) including a package with an acoustic transducer. In particular, rather than using a sealing ring to seal a cavity (e.g., an acoustic port) in a package including a transducer, a vent is used around the device opening and/or the acoustic port to vent air pressure from a device, while also preventing unwanted sound from entering the acoustic port. There are various types of acoustic transducers, including, e.g., microphones and other acoustic sensors that detect sound, or mechanical vibration, producing an electrical signal representing the sound or vibration detected.

In particular, air pressure generated within a device causes pressure to build up inside the device, which can result in cracking of the internal walls of the device and/or cracking of other internal components in the device. Therefore, the venting or release of this sound/air pressure from the device and into the atmosphere is beneficial. However, if the sound/air pressure being vented has an audio frequency, then the microphone may sense this sound/air pressure, resulting in the user hearing noise or unwanted sound. Generally, an audio frequency is a frequency within the range of 20 Hz-20 kHz. To vent the low frequency sound and/or air pressure to prevent cracking of the internal walls, while preventing the sound/air pressure with audio frequencies from being sensed by a microphone, a microphone package includes a venting mechanism surrounding an acoustic port of the microphone in the device. The venting mechanism is configured to vent low frequency (outside the audio frequency range of 20 Hz-20 kHz) sound/air pressure occurring within the device (e.g., generated inside the device) out to the atmosphere by exhibiting a low acoustic impedance to such sound/air pressure. The venting mechanism exhibits a high acoustic impedance to high frequency sounds (e.g., those sounds within the audio frequency range) generated within the device, thereby preventing these sounds from entering the venting mechanism (and being vented to the atmosphere) and also preventing this sound/air pressure with audio frequencies from being sensed by the microphone.

Figure 1:
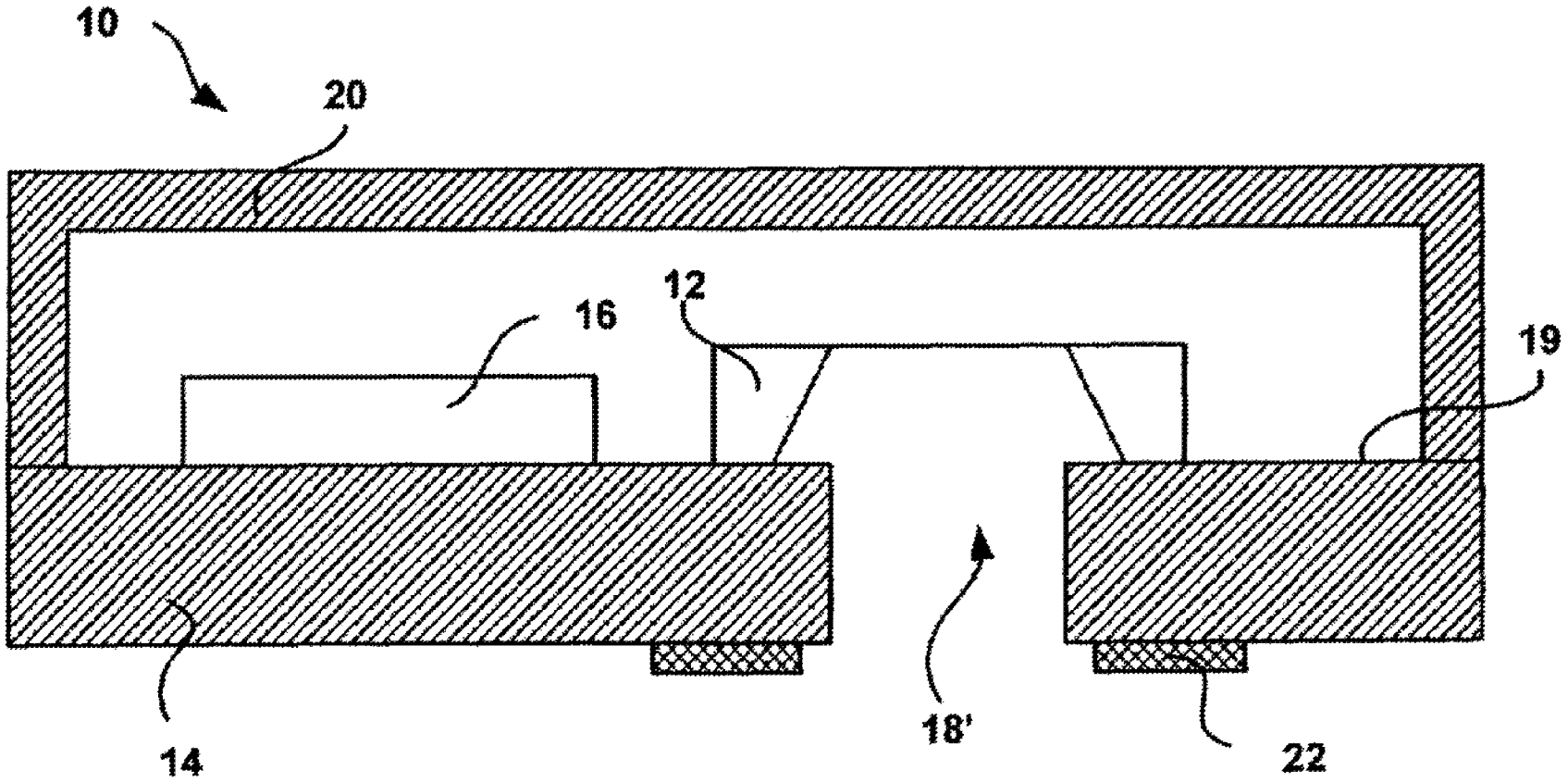
FIG. 1 (PRIOR ART)
FIGS. 1, 3B, 6A are each a diagram of a packaged device.
Figure 2:
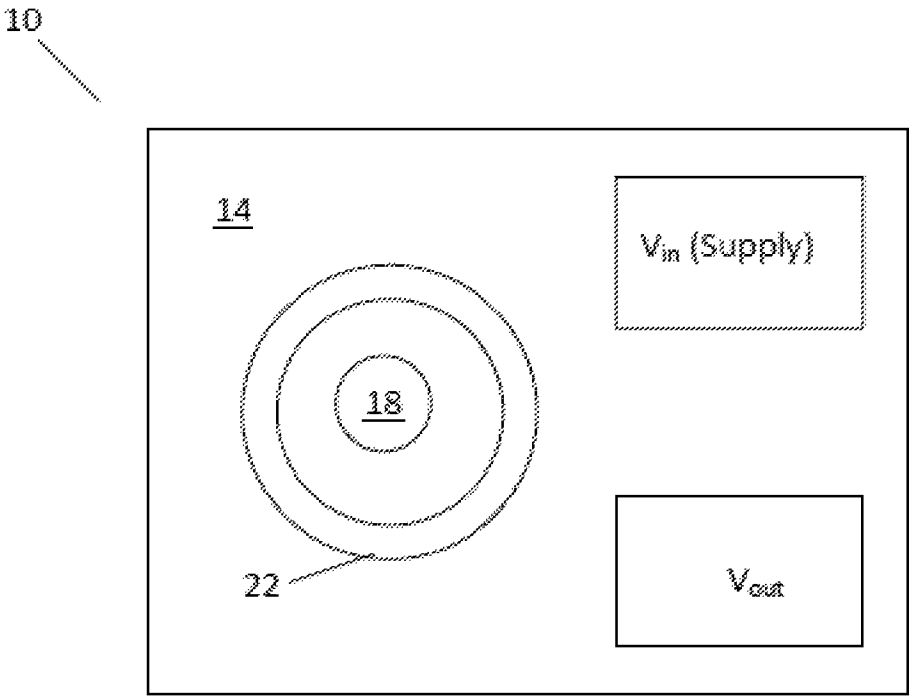
FIG. 2 (PRIOR ART)
FIGS. 2, 4 and 8A-8C are each a bird's eye view of a bottom of a package device.
Figure 3A:
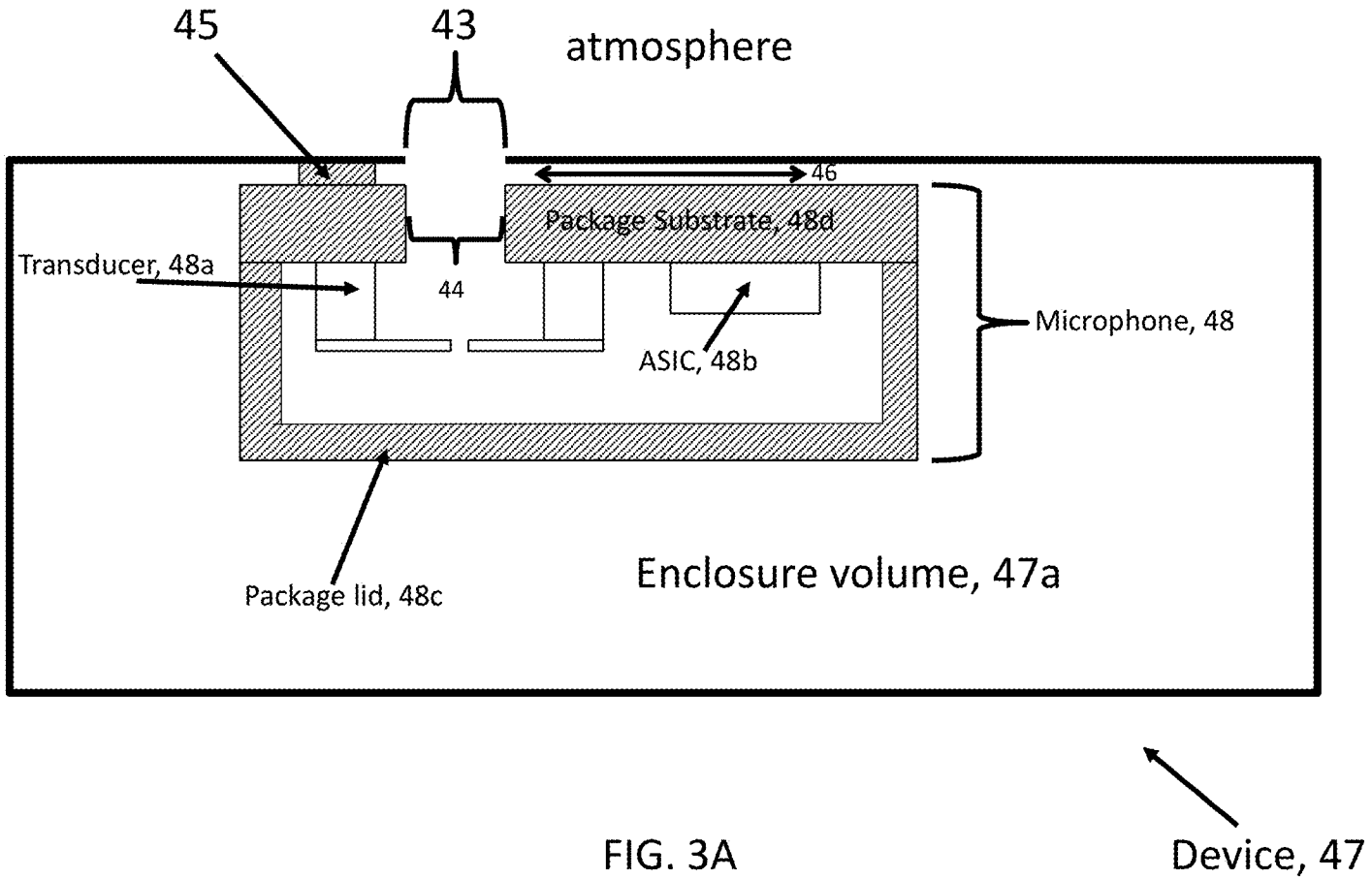
FIG. 3A is a cross-sectional view of a device.

Referring to FIG. 3A, a cross-sectional view of device 47 is shown. Device 47 includes microphone 48, which includes transducer 48*a*, application-specific integrated circuit (ASIC) 48*b*, and a package comprising package lid 48*c* and package substrate 48*d*. In this example, package lid 48*c* and package substrate 48*d* collectively form the package for holding transducer 48*a* and ASIC 48*b*. Device 47 includes enclosure volume 47*a*, e.g., a volume of air inside of device 47. In this example, microphone 48 is disposed within enclosure volume 47*a*.

In this example, device 47 includes device opening 43 for entry and release of sound waves and acoustic pressure from device 47. Microphone 48 includes acoustic port 44 for entry of sound waves into transducer 48*a*. In this example, device 47 includes venting mechanism 45 that allows sound to vent from device 47 to the environment surrounding device 47. Rather than having a sealing ring to seal acoustic port 44 of microphone 48 from enclosure volume 47*a* of device 47, device 47 includes venting mechanism 45 that is configured to filter out (e.g., prevent entry) audio frequencies (e.g., representing unwanted sound)—thereby acting as an audio filter, while venting out of device 47 other frequencies satisfying various criteria for venting out of device 47 (e.g., the criteria being that the frequencies occur outside the audio frequency range of 20 Hz-20 kHz, are less than or greater than a threshold frequency level, and so forth).

Accordingly, at audio frequencies, unwanted sound generated in in enclosure volume 47*a* of device 47 does not reach the acoustic port. Low frequency pressure changes, such as those resulting from atmospheric pressure, are vented to the atmosphere. In this example, venting mechanism 45 is structurally part of microphone 48 (e.g., by being fabricated on top of package substrate 48*d*).

In an example, venting mechanism 45 filters sound based on frequency. For sound/air pressure generated inside device 47, a gap 46 between sidewalls (not shown in this cross section view, see FIG. 4) of venting mechanism 45 is dimensioned to filter out high frequencies (e.g., audio frequencies within a range of 20 Hz-20 kHz). Gap 46 forms a vent (hereinafter referred to as "vent 46") for venting air from inside device 47 to the atmosphere. This sound/air pressure with high frequencies that is generated inside device 47 encounters a high impedance at the gap between the sidewalls of venting mechanism 45. This high impedance prevents the sound/air pressure at the audio frequencies from entering venting mechanism 45. As such, this sound/air pressure remains in enclosure volume 47*a* of device 47 and doesn't enter acoustic port 44, thereby preventing this high frequency sound/air pressure from being sensed by microphone 48 and preventing this high frequency sound from being heard by a user of device 47.

In this example, sound/air pressure with low frequencies (that are generated inside the device) vent to the atmosphere via vent 46, e.g., which is a gap between the sidewalls in venting mechanism 45. Generally, low frequency sound/air pressure is sound/air pressure at a frequency that is inaudible to the human ear and outside the audio frequency range. The gap between the sidewalls of venting mechanism 45 is dimensioned to exhibit a low impedance to these low frequency sounds/air pressure. Due to this low impedance, this low frequency sound/air pressure generated inside device 47 enters the gap between the sidewalls in venting mechanism 45 and vents to the atmosphere. This low frequency sound/air pressure could be sensed by microphone 48, depending on microphone performance, as the sound/air pressure is venting to the atmosphere. However, because this sound/air pressure is outside the audio frequency range, it does not impact microphone performance or result in audible noise to the user of device 47.

For sound/air pressure coming from the atmosphere, high and low frequencies see low impedance at acoustic port 44 and are sensed by microphone 48, to enable microphone 48 to pick-up this sound. High frequencies coming from the atmosphere see high impedance to the device body (e.g., enclosure volume 47*a*), e.g., via the gap between the sidewalls of venting mechanism 45, thereby preventing these high frequencies from entering enclosure volume 47*a* of device 47.

In an example, the acoustic port causes resistance that acts as a natural filter and the acoustic port is electrically connected to the rest of the package. However, the acoustic port is not sealed, because there is a vent. The vent, along with the transducer, also has an inherent resistance that acts as a filter. On some devices, especially wearable devices, the acoustic port of a microphone and the device opening (that allows sound to access and enter the acoustic port) may be the only openings to the environment and the remainder of the device might be sealed. In this case, it is desirable to place a controlled vent to the atmosphere to allow atmospheric pressure changes to equalize inside such a device, e.g., by venting out to the atmosphere. This vent is built into the microphone packaging without impacting microphone performance.

Figure 3B:
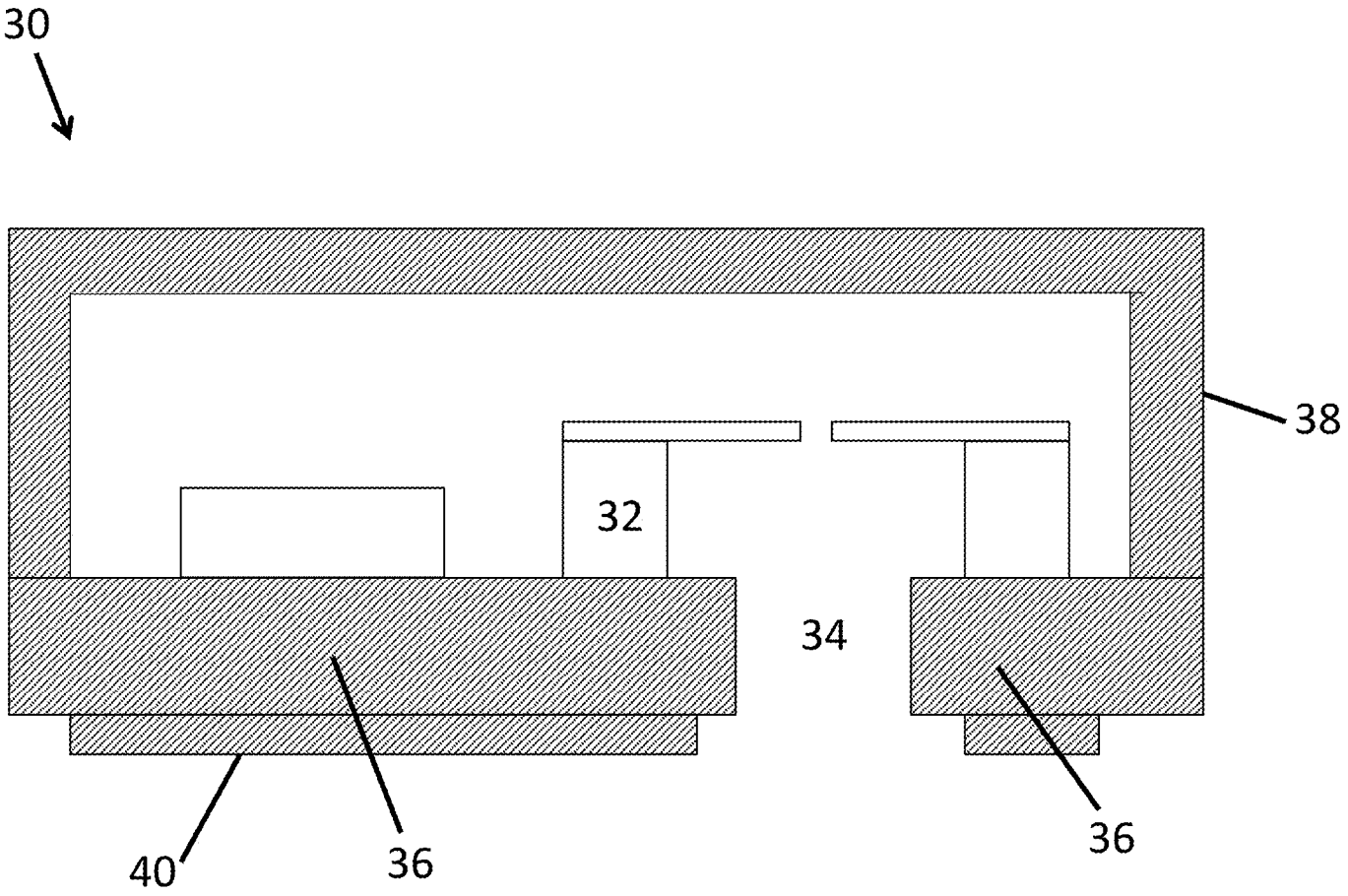

Referring to FIG. 3B, package 30 includes transducer 32 that is affixed to substrate 36. Cover 38 covers substrate 36. Acoustic port 34 is formed in substrate 36 to form an acoustic path to transducer 32. In an example, transducer is a transducer described in U.S. Pat. No. 8,531,088 and/or fabricated using the techniques described in U.S. Pat. No. 8,531,088, the entire contents of which are incorporated herein by reference. Venting mechanism 40 partially surrounds acoustic port 34 to form a vent around acoustic port 34.

Figure 4:
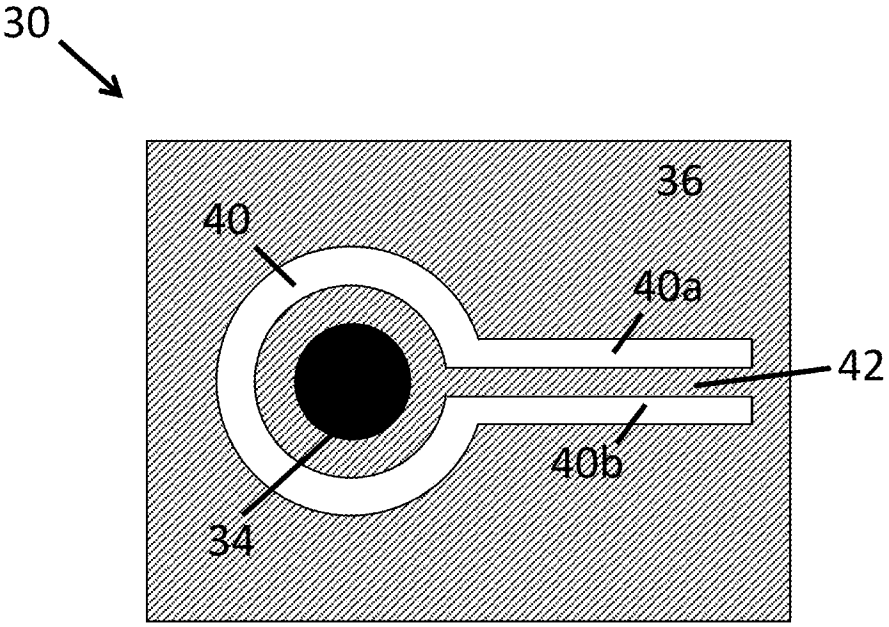

Referring to FIG. 4, a bird's eye view of the bottom of package 30 is shown. In this example, venting mechanism 40 is in proximity to port 34. Venting mechanism 40 is formed from solder that is soldered onto the bottom of substrate 36. Venting mechanism 40 forms vent 42 to vent air and sound pressure from a device that includes package 30 out to the atmosphere. In this example, venting mechanism 40 has a U shape and is fabricated from solder paste.

Venting mechanism 40 includes venting sidewalls (or vent arms) 40*a*, 40*b*. In this example, vent 42 is a gap between sidewalls 40*a*, 40*b*. When venting sidewalls 40*a*, 40*b* are closer together, venting mechanism 40 has a higher resistance, e.g., relative to a resistance of venting mechanism 40 when venting sidewalls 40*a*, 40*b* are further away from each other. By adjusting the spacing between venting sidewalls 40*a*, 40*b*, the resistance of venting mechanism 40 is adjustable. Accordingly, the resistance of venting mechanism 40 can be adjusted to a threshold resistance or frequency to filter high frequencies, such that low frequency sounds (or air pressures) equalize and pass through the vent, while high frequency sounds encounter a high impedance (e.g., at the gap between the venting sidewalls) that prevents these high frequency sounds or air pressure from entering the venting mechanism, thereby ensuring that these high frequency sounds do not enter the acoustic port and ensuring that these high frequency sounds are not audible to a user of the device. As such, these high frequency sounds or air pressure remain in the enclosure volume and are not vented out to the atmosphere.

In this example, venting mechanism 40 includes an open ring, rather than a sealed ring. Venting mechanism 40 is attached to a structure, e.g., a board in a mobile device and acts as an acoustic filter that will knock out high frequency roll off. The solder used in forming venting mechanism 40 can be made of various materials, including, e.g., solder, metals, epoxy, fiberglass, plastic and so forth. Additionally, venting mechanism 40 can include various shapes and design structures, e.g., curled, straight, zig zag, U-shaped, and so forth. Additionally, venting mechanism 40 can be structured and fabricated to cover various spec targets, e.g., such as a high frequency response, and so forth.

Figure 5:
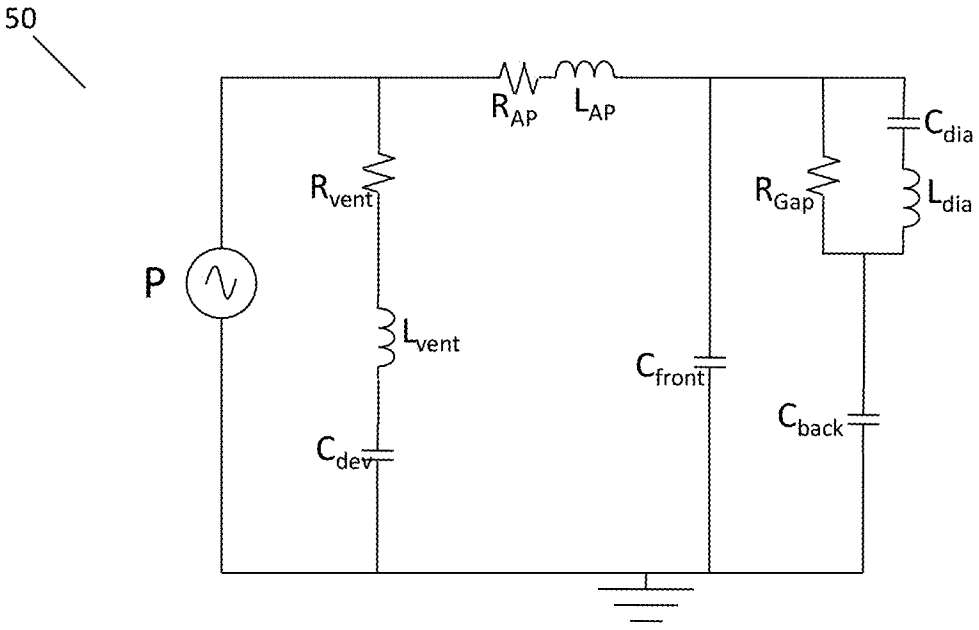
FIGS. 5, 7 are each a diagram of an equivalent circuit model of a package.

Referring to FIG. 5, equivalent circuit model 50 of a package (e.g., package 30) is shown. In this example, P represents pressure due to sound coming into the microphone portion of a device (such as a mobile device). $R_{vent}$ is an acoustic resistance of a vent (e.g., vent 42). Lentis an acoustic mass of a vent (e.g., vent 42). $C_{dev}$ is an acoustic compliance of the device and represents a volume of air sealed in the device in accordance with the following equation:

$$C_{Dev} = \frac{V}{\rho c^2}$$

V the volume of air in the device. ρ is the density of air. c is the speed of sound.

The vent allows a sealed device to equalize atmospheric pressure. Without the vent, the atmospheric pressure may introduce a pressure differential across $C_{dev}$ This pressure differential would then stress the walls of the device and could cause cracking or breaking.

$R_{AP}$ is an acoustic resistance of an acoustic port. $L_{AP}$ is an acoustic mass of an acoustic port. $C_{front}$ is an acoustic compliance in the front the device. $C_{back}$ is an acoustic compliance in the back the device. $C_{dia}$ an acoustic compliance of a diaphragm in the package. $L_{dia}$ is an acoustic mass of a diaphragm in the package. $R_{Gap}$ is an acoustic resistance across a gap (e.g., gap 68 in FIG. 6A) in the transducer, as described below. In this example, the vent does not impact the acoustical performance of the microphone, because the resistance of the vent allows wanted sound (e.g., sound from the environment) to be received by the microphone, but also filters out unwanted sound (e.g., sound coming from the device) from reaching the microphone.

Figure 6A:
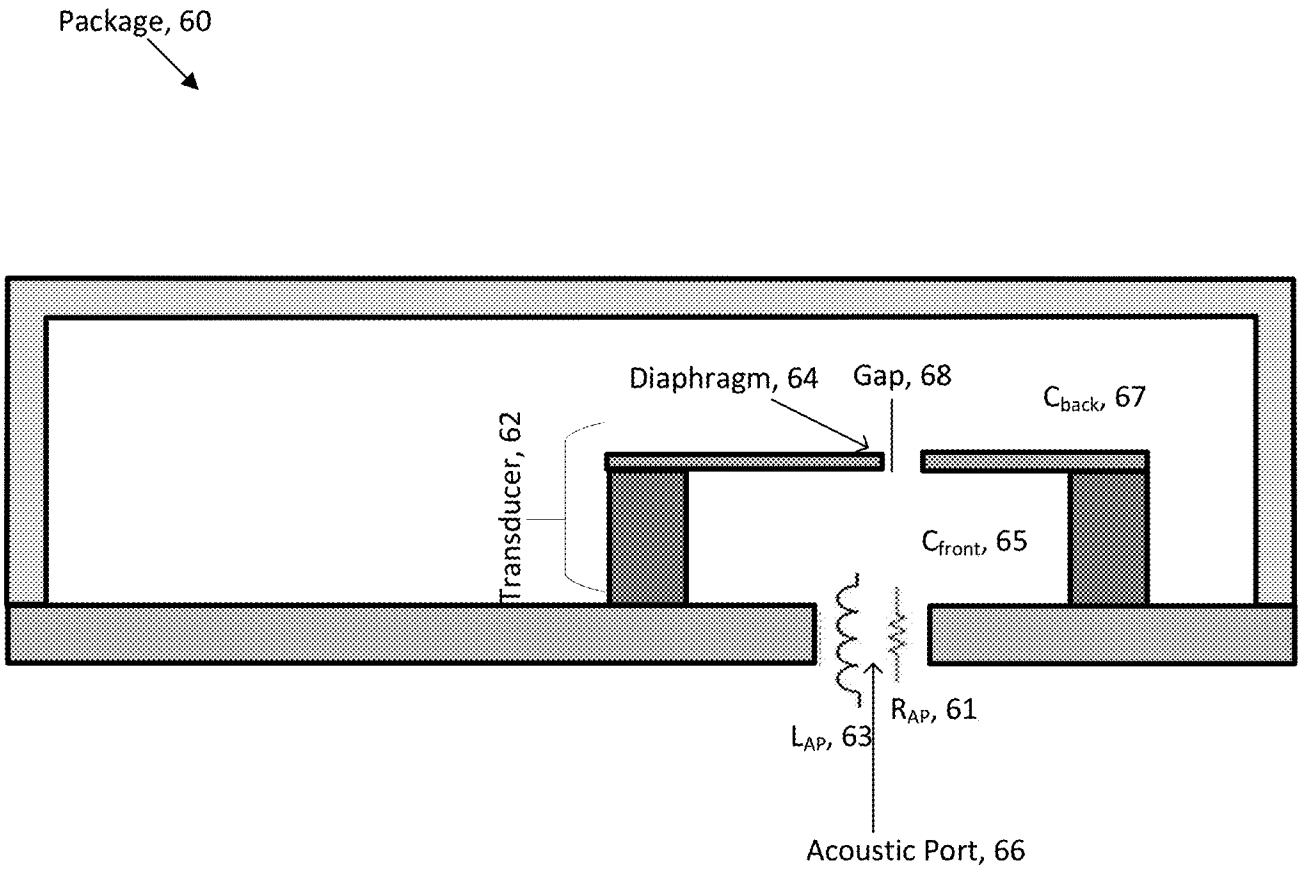

Referring to FIG. 6A, package 60 (such as a transducer package) includes a transducer 62 (such as a microphone, piezoelectric transducer, a silicon microphone, a piezoelectric microphone, silicon condenser microphone and so forth) with a diaphragm 64 (e.g., the moving portion of the sensor or transducer). The microphone 62, including the diaphragm 64, is fabricated using a MEMS process, such as the one described in U.S. Pat. No. 8,531,088, the entire contents of which are incorporated herein by reference. In this example, the transducer 62 comprises of various materials, including, e.g., a piezoelectric material; AlN PZT, ScAlN, LiNbO3, LiTaO3, GaN, GaAs, etc. In one example, the transducer 62 is a piezoelectric microphone that uses piezoelectricity to produce an electrical signal from air pressure variations.

FIG. 6A also illustrates the portions of package 60 that correspond to portions in equivalent circuit model 50 of a package. For example, $R_{AP}$ 61 and $L_{AP}$ 63 of the acoustic port 66 are shown. $C_{front}$ 65 and $C_{back}$ 67 are also shown. In a variation, the transducer comprises silicon and the transducer is a silicon microphone in which the transducer is die bonded to the substrate. The transducer is fabricated on various types of die, including, e.g., a silicon die (of a silicon substrate). In still other variation, the transducer is a silicon condenser transducer or a silicon condenser microphone. Generally, a condenser microphone is a microphone that uses a capacitor to convert the compression and rarefaction of sound waves into electrical energy. Generally, a silicon microphone is a type of acoustic sensor made from silicon or polysilicon.

Figure 6B:
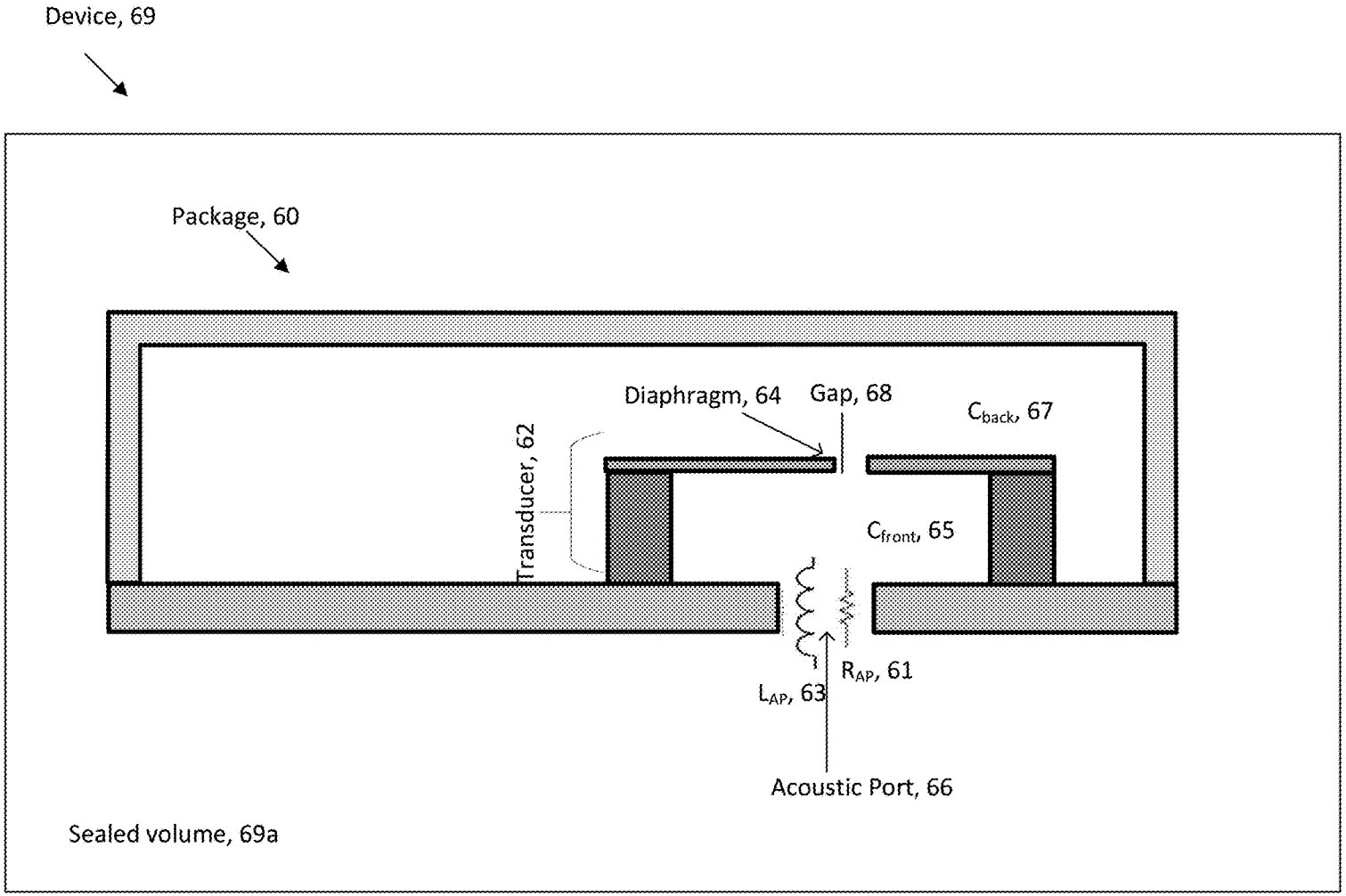
FIG. 6B is a diagram of a device including a packaged device.

Referring to FIG. 6B, a variation of FIG. 6A is shown in which package 60 is included with device 69 (e.g., a sealed device). In this example, device 69 includes sealed volume 69*a* in which package 60 is located. In this example, transducer 62 is disposed within sealed volume 69*a* of device 69.

Figure 7:
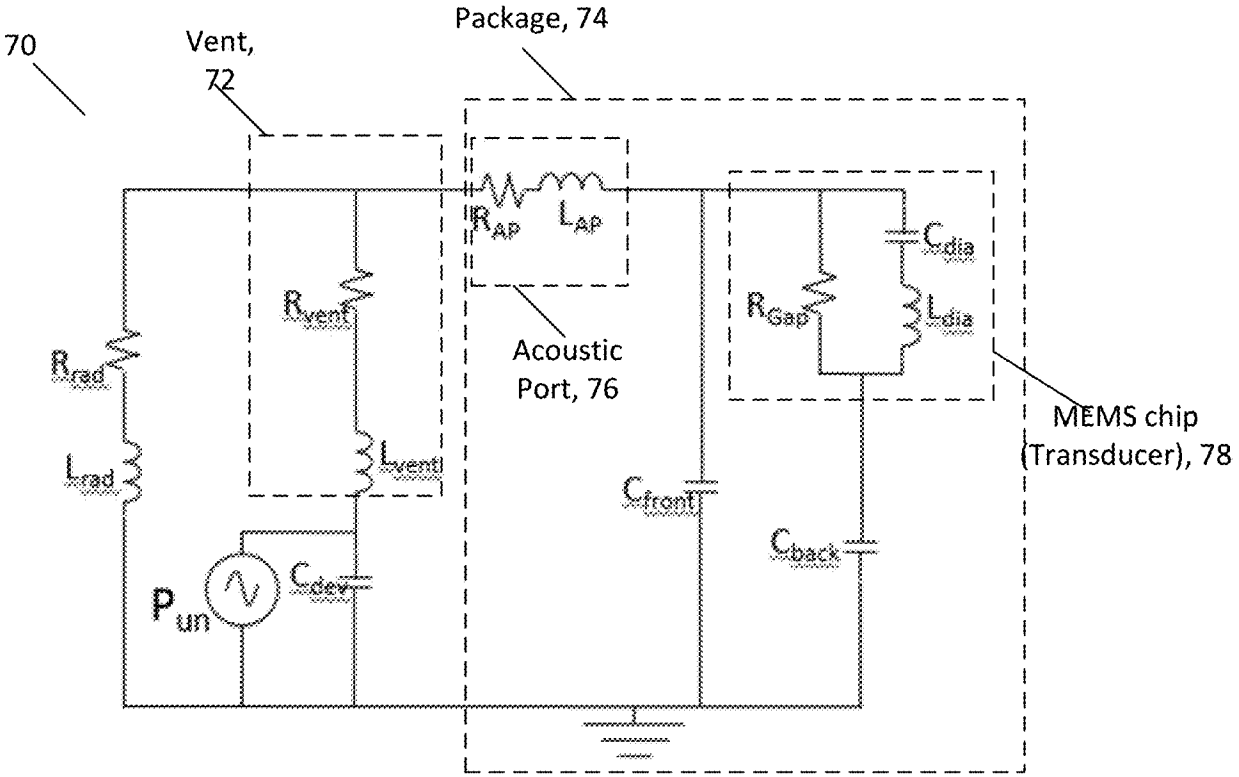

Referring to FIG. 7, equivalent circuit model 70 of a package (e.g., package 30) is shown. In this example, high vent resistance prevents unwanted sound from reaching the microphone port, by filtering out the unwanted sound (e.g., by filtering out audio frequencies, which are likely to be unwanted sound coming from within the device). Pun represents unwanted sound due to pressure (and/or a simulation of unwanted sound via pressure), such as the pressure caused by a user pressing a screen on a mobile device or by pressing buttons on a mobile device. $R_{Rad}$ is an acoustic radiation ("rad") resistance. If there was a large amount of resistance caused by external air, there is an increased chance of sound pressure entering the microphone. Lad is radiation ("rad") mass caused by external air. In this example, portions 72, 74, 76 and 78 specify portions of model 70 that represent the vent, package, acoustic port and transducer, respectively. $R_{vent}$ is an acoustic resistance of a vent (e.g., vent 42). Lentis an acoustic mass of a vent (e.g., vent 42). $C_{dev}$ is an acoustic compliance of the device. $R_{AP}$ is an acoustic resistance of an acoustic port. $L_{AP}$ is an acoustic mass of an acoustic port. $C_{front}$ is an acoustic compliance in the front the device. $C_{back}$ is an acoustic compliance in the back the device. Calais an acoustic compliance of a diaphragm in the package. $L_{dia}$ is an acoustic mass of a diaphragm in the package. $R_{Gap}$ is an acoustic resistance across a gap in the transducer, as described below.

Figure 8A:
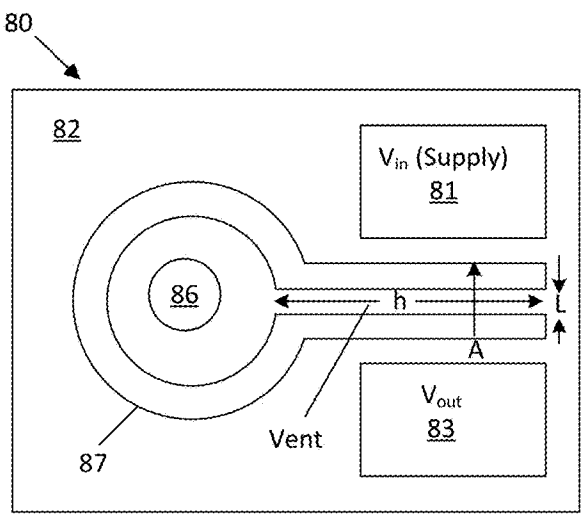
Figure 8B:
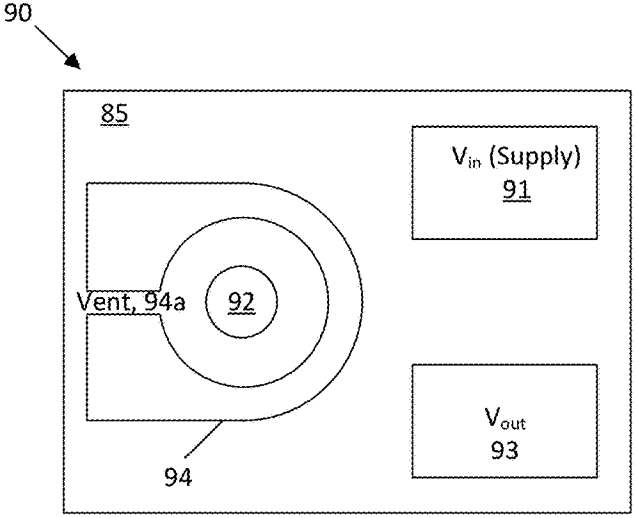
Figure 8C:
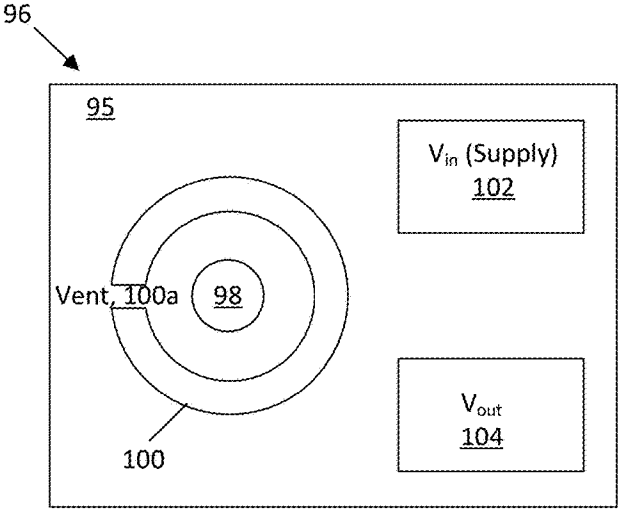

Referring FIGS. 8A-8C, venting mechanisms 87, 94, 100 are various shapes and dimensions. In the example of FIG. 8A, diagram 80 illustrates a bird's eye view of a bottom of package 82 with supply voltage ($V_{in}$) 81 and an output voltage 83. In this example, cavity 86 is a bird's eye view of an opening into an acoustic port. (In an example, cavity 86 includes the acoustic port). Venting mechanism 87 is fabricated around cavity 86 to vent into a portion of a device that holds package 82. In this example, "h" represents a longitudinal length of the vent, as shown in FIG. 8A. "L" represents a cross-sectional length of the vent. "A" represents an area of the vent.

Figure 8D:
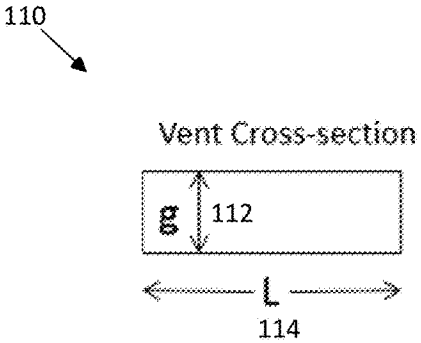
FIG. 8D is a diagram of a vent cross-section.

Referring to FIG. 8B, diagram 90 illustrates that a vent surround an opening in an acoustic port can have various shapes and sizes. In this example, package 85 includes opening 92 into an acoustic port (not shown). In an example, opening 92 includes and/or is the acoustic port. In this example, the bottom of package 85 is visually depicted. Venting mechanism 94 at least partially surrounds opening 92 in accordance with the design and shape shown in FIG. 8B. Venting mechanism 94 forms vent 94*a* to vent or exhaust air/pressure out of the package. In this example, package 85 includes supply voltage (Vin) 91 and an output voltage 93. Referring to FIG. 8C, diagram 96 shows a bottom of package 95 with an opening 98 into an acoustic port. In an example, opening 98 includes and/or is the acoustic port. In this example, venting mechanism 100 at least partially surrounds opening 98 and includes a circular shape. Vent 100*a* is formed by an opening in venting mechanism. Package 95 includes supply voltage 102 and output voltage 104. Referring to FIG. 8D, a vent cross-section of vent 110 is shown. In this example, "g" (112) represents the cross-sectional height of the vent 110. "L" (114) represents a cross-sectional length of the vent 110.

In the examples described herein, $R_{vent}$ is determined in accordance with $$R_{Vent} = \frac{12\ \mu h}{g^3 L},$$

wherein μ is viscosity.

In the examples described herein, acoustic mass of the vent ($L_{vent}$) is determined in accordance with:

$$L_{Vent} = \frac{\rho_0}{\pi \mathcal{R}^2}(L + 1.7\ \mathcal{R}),$$

where ρ the density of air and $\mathcal{R}$ is the effective radius of the vent, approximated as the radius of a circle with the same cross-sectional area as the vent.

Figure 9:
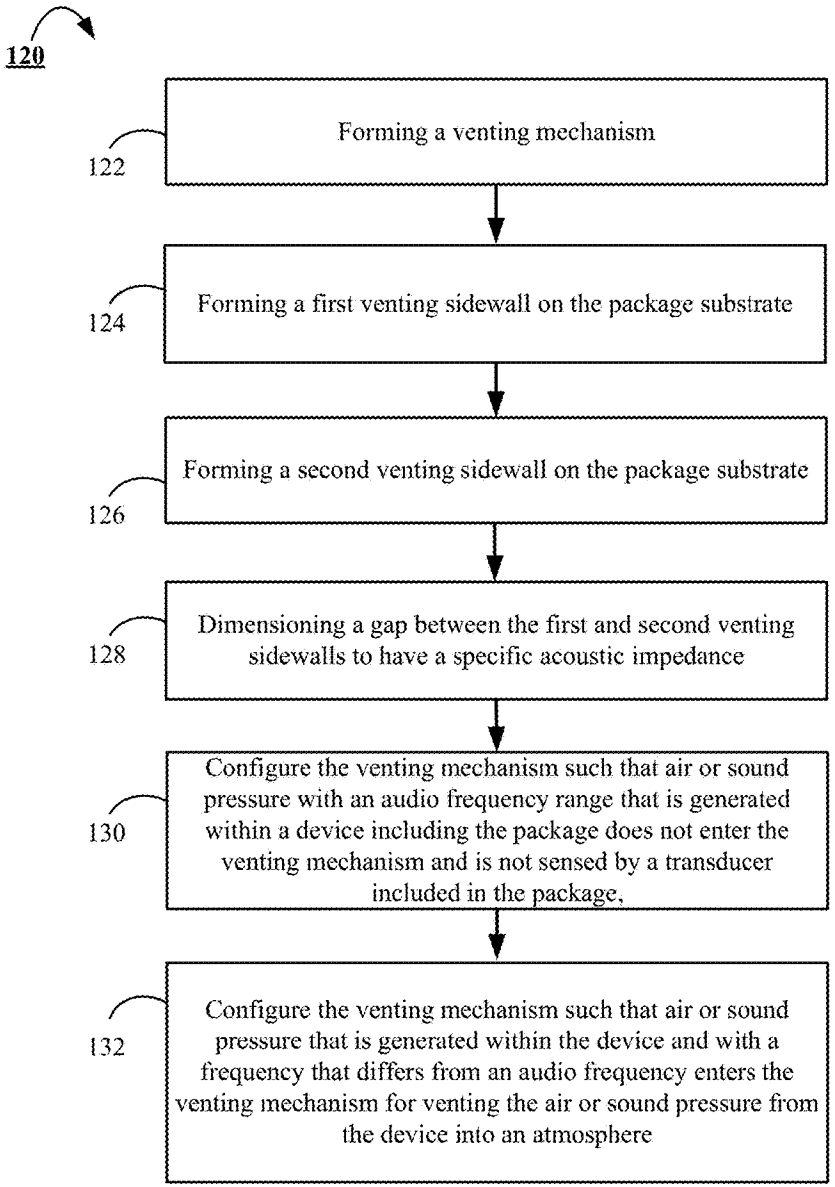
FIG. 9 is an example process for forming a venting mechanism.

Referring to FIG. 9, process 120 for forming or fabricating a venting mechanism and associated vent includes the following operations. In operation, a system or entity forms (122) a venting mechanism on a package substrate of a package and around an acoustic port of the package substrate, by: forming (124) a first venting sidewall on the package substrate; forming (126) a second venting sidewall on the package substrate that is substantially opposite to the first venting sidewall on the package substrate; dimensions (128) a gap between the first and second venting sidewalls to have a specific acoustic impedance to configure (130) the venting mechanism such that air or sound pressure with an audio frequency range that is generated within a device including the package does not enter the venting mechanism and is not sensed by a transducer included in the package, and to configure (132) the venting mechanism such that air or sound pressure that is generated within the device and with a frequency that differs from an audio frequency enters the venting mechanism for venting the air or sound pressure from the device into an atmosphere. In some examples, the forming comprises applying solder around the acoustic port in a shape that forms the venting mechanism.

Embodiments can be implemented in digital electronic circuitry, or in computer hardware, firmware, software, or in combinations thereof. Apparatus can be implemented in a computer program product tangibly embodied or stored in a machine-readable storage device for execution by a programmable processor; and method actions can be performed by a programmable processor executing a program of instructions to perform functions by operating on input data and generating output. The techniques described herein can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD_ROM disks. Any of the foregoing can be supplemented by, or incorporated in, ASICs (application-specific integrated circuits).

Other embodiments are within the scope and spirit of the description and the claims. Additionally, due to the nature of software, functions described above can be implemented using software, hardware, firmware, hardwiring, or combinations of any of these. The use of the term "a" herein and throughout the application is not used in a limiting manner and therefore is not meant to exclude a multiple meaning or a "one or more" meaning for the term "a." Additionally, to the extent priority is claimed to a provisional patent application, it should be understood that the provisional patent application is not limiting but includes examples of how the techniques described herein may be implemented.

A number of embodiments have been described. Nevertheless, it will be understood that various modifications may be made without departing from the spirit and scope of the claims and the examples of the techniques described herein.

What is claimed is:

1. A packaged device comprises:

a transducer;

a package substrate having an acoustic port, with the transducer supported over a surface of the package substrate and over or adjacent to the acoustic port; and a venting mechanism affixed to the package substrate, the venting mechanism proximate to and partially surrounding the acoustic port of the package substrate, the venting mechanism comprised of a material patterned to provide first and second adjacent sidewalls along a surface of the package substrate adjoined at a first end of the venting mechanism and that are spaced by a gap that provides a vent for venting air or sound pressure from an enclosure volume of the device.

2. The package of claim 1, wherein the gap width is a fixed gap width that provides a specific acoustic impedance so that air at a sound pressure within an audio frequency range does not enter the venting mechanism and is not sensed by the transducer, and air at a sound pressure within the audio frequency range enters the venting mechanism for venting.

3. The package of claim 1, wherein the first end of the venting mechanism, at which the sidewalls are adjoined includes a portion that is an open ring that adjoins the pair of first and second adjacent sidewalls.

4. The package of claim 3 wherein the open ring of the venting mechanism is around the acoustic port.

5. The package of claim 1, wherein the material of venting mechanism is from one or more of solder, a metal, epoxy, plastic and fiberglass.

6. The package of claim 1, wherein the venting mechanism is associated with a threshold frequency level, wherein the venting mechanism is configured to vent out of the device sound pressure with a frequency that exceeds or is less than the threshold frequency level.

7. The package of claim 1, wherein the transducer is disposed within a sealed volume of the device.

8. The package of claim 1, wherein the transducer is a piezoelectric transducer, a silicon microphone, a piezoelectric microphone or a silicon condenser microphone.

9. The package of claim 1, wherein the transducer is comprised of one or more of AlN, PZT, ScAlN, LiNbO3, LiTaO3, GaN and GaAs.

10. A device comprising:

a transducer;

a package substrate supporting the transducer and comprising an acoustic port; and a venting mechanism affixed to the package substrate, the venting mechanism proximate to and partially surrounding the acoustic port of the package substrate, the venting mechanism comprised of a material patterned to provide a pair of first and second adjacent sidewalls that are adjoined by a portion that includes an open ring of the material, and with the pair of first and second adjacent sidewalls along the package substrate and which first and second adjacent sidewalls are spaced by a gap of a fixed gap width and which gap provides a vent for venting air or sound pressure from an enclosure volume of the device.

11. The device of claim 10, wherein the fixed gap width is dimensioned to have a specific acoustic impedance so that air at a sound pressure within an audio frequency range does not enter the venting mechanism and is not sensed by the transducer, and air at a sound pressure within the audio frequency range enters the venting mechanism for venting.

12. The device of claim 10, wherein the open ring is disposed about the acoustic port.

13. The device of claim 10, wherein the venting mechanism forms a vent around the acoustic port.

14. The device of claim 10, wherein the venting mechanism is fabricated from one or more of solder, a metal, epoxy, plastic and fiberglass.

15. The device of claim 10, wherein the venting mechanism is associated with a threshold frequency level, wherein the venting mechanism is configured to vent out of the acoustic device sound pressure with a frequency that exceeds or is less than the threshold frequency level.

16. The device of claim 10, further comprising a piezoelectric transducer, a silicon microphone, a piezoelectric microphone or a silicon condenser microphone.

17. The device of claim 10, further comprising a transducer is comprised of one or more of AlN, PZT, SLAIN, LiNbO3, LiTaO3, GaN and GaAs.

18. The device of claim 10, wherein the transducer is disposed within a sealed volume of another device.

* * * * *